United States Patent [19]

Higgins

[11] 4,286,710

[45] Sep. 1, 1981

[54] CHRISTMAS CANDLE PACKAGE

[76] Inventor: Janet D. Higgins, 157 Candlewick La., Bridgewater, N.J. 08807

[21] Appl. No.: 98,120

[22] Filed: Nov. 28, 1979

[51] Int. Cl.[3] ..... B65D 77/00; B65D 85/00

[52] U.S. Cl. ..... 206/216; 206/575

[58] Field of Search ..... 206/573, 575, 223, 216, 206/38 R, 305, 443, 526, 527; 431/289, 291; 220/23; 229/55

[56] References Cited

U.S. PATENT DOCUMENTS

| | | | |
|---|---|---|---|
| 38,672 | 5/1863 | Gleason | 431/289 |
| 164,620 | 6/1875 | Watson | 206/38 R |
| 1,869,712 | 8/1932 | Palmer | 220/23 |
| 2,481,019 | 9/1949 | Joyce | 431/289 |
| 2,792,110 | 5/1957 | Wanish | 206/305 |
| 3,066,847 | 12/1962 | Fortune | 229/55 |
| 3,124,247 | 3/1964 | Churchill | 206/443 |
| 3,162,305 | 12/1964 | Schoppa | 206/526 |
| 3,330,091 | 7/1967 | Quinn | 206/219 |

FOREIGN PATENT DOCUMENTS

| | | | |
|---|---|---|---|
| 1194315 | 6/1970 | United Kingdom | 431/291 |

OTHER PUBLICATIONS

"*Luminaria*" Article in *New Mark News,* Rockville, MD., Dec. 1976.

*Primary Examiner*—William T. Dixson, Jr.
*Attorney, Agent, or Firm*—Laverne D. Geiger

[57] ABSTRACT

A Christmas candle package for a decoration or display has a container, a candle, a quantity of sand, a candle lighter and a tape measure.

1 Claim, 8 Drawing Figures

FIG. 5
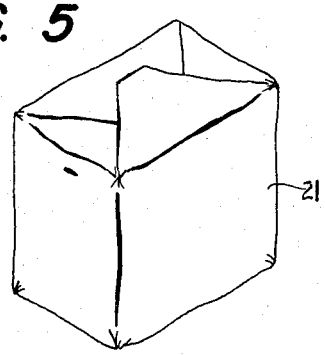
FIG. 7
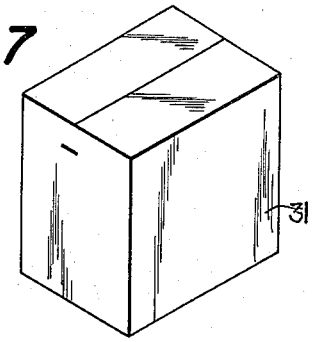
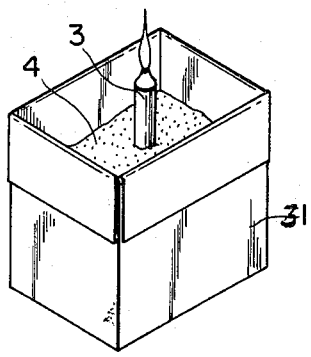
FIG. 8
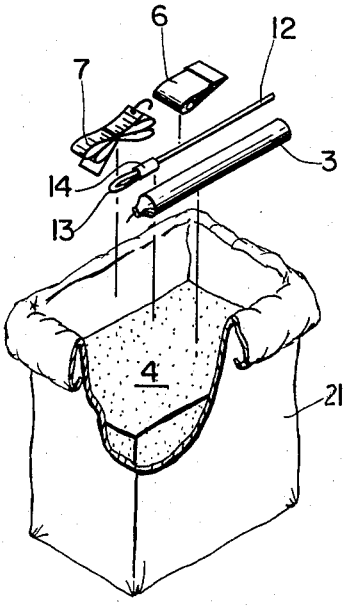
FIG. 6
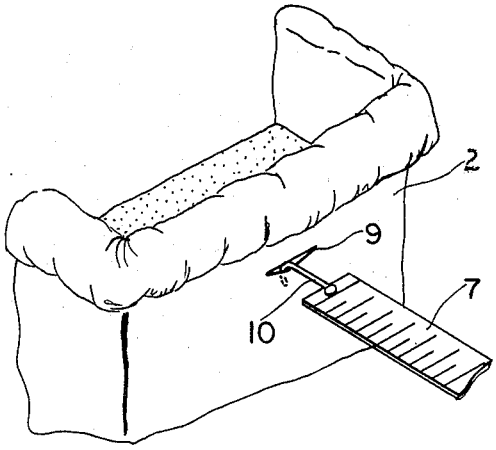
FIG. 4

CHRISTMAS CANDLE PACKAGE

BACKGROUND, SUMMARY AND OBJECTS OF THE INVENTION

The burning of candles goes back into antiquity. Since the beginning of human history candles have been used for illumination. But a burning candle has also been accorded a high artistic, religious and sentimental place in human life and activity. In art, religion and literature the candle has been symbolic of many human emotions. It usually represents joy, reverence and sacrifice, and has a central place in many religious rites.

To burn properly a candle must be supported. The usual support is a candle holder or candlestick. In early forms of candle holders the candle was held on a spike or pricket, while the Romans generally used a socket support. Both forms of support have remained in use to the present day.

The present invention relates to a package which is ready to be used on festive occasions, especially at Christmastime. Burning candles spaced along a lane, or path, or street are a beautiful and moving sight. But to provide such a sight requires much more than lighting a candle. The candles must be supported in place, be spaced attractively, burn a proper length of time, and be protected from the wind.

The present invention discloses a package or kit which includes a container, a bag, a candle, means for supporting the candle, a means for lighting the candle, a protective means to prevent the candle from being extinquished while it is burning outside in the wind, and a tape measure which may be used to space the burning candles from each other. The means for supporting the candle supports a burning candle and also supports the bag and its walls to maintain the bag in a desired position. A series of open packages may be spaced along a line, (straight or curved) at measured distances from each other with each of the respective candles burning, thus providing a decorative effect for special occasions such as Christmas.

It is therefore an object of this invention to provide a package which furnishes the user with the necessary articles, tools, and equipment to decorate his driveway or street with a row of burning candles which stay in place and burn a desired length of time.

It is further object of this invention to provide a package which includes a container, a candle, support means for the candle, means to light the candle and a tape measure.

It is another object of this invention to provide a package which includes more than one bag, sand, means for measuring the sand into the bags, one or more tape measures, one or more candles for each bag, and a match holder.

It is a further object of this invention to provide a package comprising a container, a candle and a candle support wherein the container holds the candle and the support when the container is closed and provides a shield for a burning candle when the container is open.

It is also an object of this invention to provide a package comprising a container, a candle and a candle support wherein the candle support also maintains the container in a selected position when the package is either open or closed.

It is another object of this invention to provide a festive decoration comprising a series of open packages spaced at measured distances from each other, each open package containing a means for maintaining its package in position and for also supporting a burning candle.

It is a further object of this invention to provide, in a neat compact package or kit, all of the necessary elements for maintaining a burning candle outside in the open air.

DESCRIPTION OF THE DRAWING

FIG. 4 is a view of a bag and a tape measure hooked into the bag wall.

FIG. 5 is a view of another form of the package where the bag serves as the container itself and is closed.

FIG. 6 is a diagrammatic view of the package of FIG. 5 in open position and showing the contents.

FIG. 7. is a view of another form of the package where the walls are of stiff rigid material.

FIG. 8 is a view showing a candle supported in the sand in the package of FIG. 7 with the package in open position.

DESCRIPTION OF PREFERRED EMBODIMENT OF THE INVENTION

Figure 1:
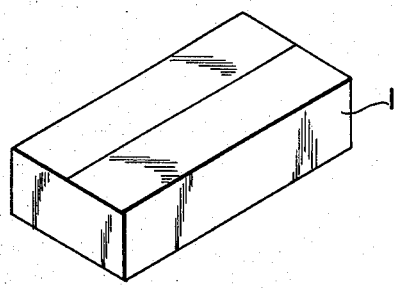
FIG. 1 is a view of a closed package.
Figure 2:
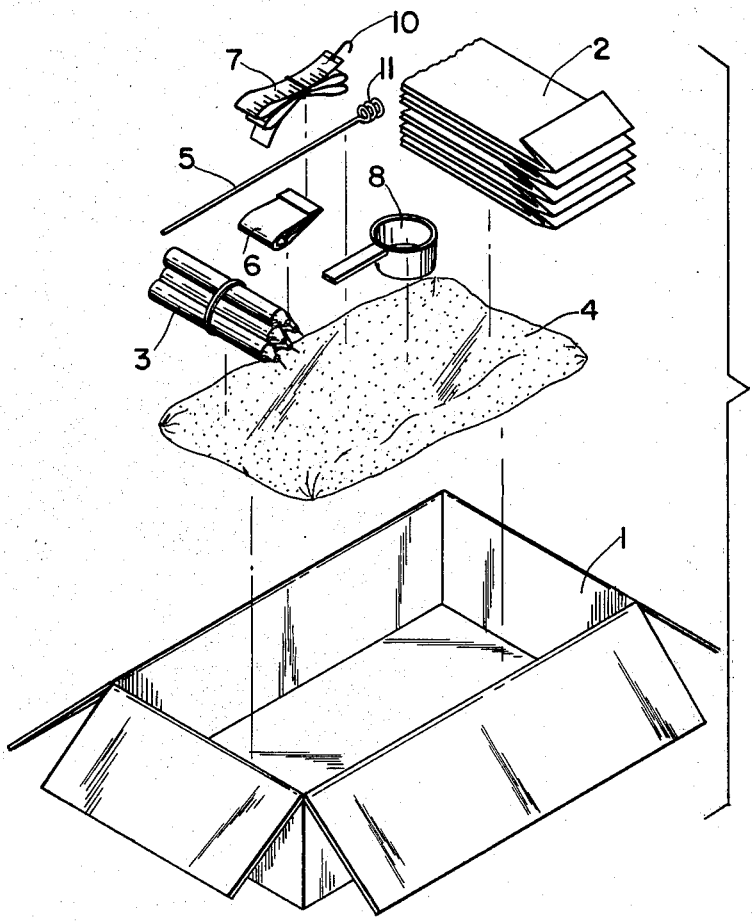
FIG. 2 is a diagrammatic view of the package of FIG. 1 in open position and showing its contents.
Figure 3:
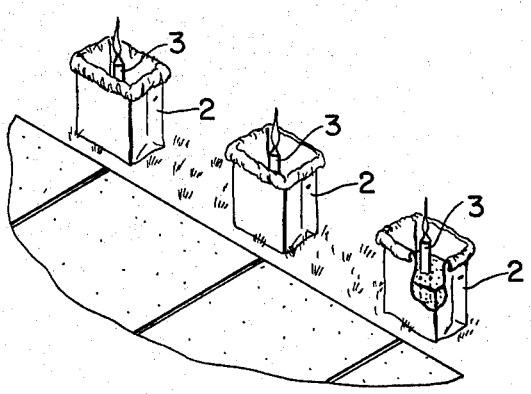
FIG. 3 is a view of a row of burning candles.

In the preferred embodiment of my invention illustrated in FIGS. 1 and 2 I have shown a package comprising a container, box or tray 1 holding enough material to provide an entire row of burning candles. When burning candles are located away from drafts and moving air they can usually be held in some form of readily available candle holder. However problems arise when a candle is to be kept burning outside in the open air. My candle is kept burning outside in the open air. My candle package provides all of the necessary elements for providing a burning candle under such conditions. Several candles burning outside in a row, as for example, along a street or sidewalk in front of a house, present a festive decorative feature which is particularly appropriate on special occasions, as for example, at Christmas. Such a row is shown in FIG. 3.

My package includes one or more bags 2, one or more candles 3, some sand 4 (or any similar material) to support a candle, a candle lighter 5 to hold a match 6, a tape measure 7, and a sand measure 8 to measure the sand into the bags. This offers a neat, compact package which may be opened at a desired location where it is ready for immediate use. Many users would find it difficult to assemble each of these different elements and so I have provided a package or kit holding each of these cooperating elements. The sand-like material acts both as a weight to keep the open package and the individual bags in palce and as a holder for the candle. The container holds all of the elements together in a package when the container is closed; and when the container is open it retains the sand-like material which is holding the candle. At the same time the erect walls of the bag act as a windbreak to keep the candle from being extinguished in the wind. The bags may be arranged in a predesignated formation and the sand measure used to place the required amount of sand into each bag. The candle is placed into the sand. The sand serves the purpose of holding each candle erect in position and also of holding the bag in position in the tray while the bag is being filled and later in final position along the driveway or street. The term "sand" used in the specification and claims is intended to include any such suitable material. The quantity of sand in the package is dependent upon the sizes of the candle and the container which are selected. These sizes are entirely a matter of choice and are largely dependent upon the length of time the user intends the candle to burn.

The bags with the sand are then placed in position along the driveway or street. Since it is usually preferable to space the bags a selected distance apart, tape measure 7 may be used to measure such distance. In order to make it easier for a lone person to locate the bags, the bags may have a small opening 9, shown in FIG. 4. The opening may be formed either partially or entirely through the wall. Also, the end of the tape may be provided with a hook 10 to fit into the small opening 9 in the bag to hold the end of the tape as the user walks along to the next bag location. Since it is difficult to reach down into the bag with a lit match it is preferable to use a candle lighter to light the candle. However, if desired, the candle may be lit by using an ordinary match alone. The candle lighter should be simple and inexpensive and may have any desirable shape or form. FIG. 2 illustrates one form of lighter 5. A wire is curled at one end into a spiral coil 11 into which a match may be secured. The wire has sufficient stiffness to support itself and the match, but is flexible enough to be bent to fit into the package. The coil may taper slightly in order to firmly hold matches with variations in diameter. The lighter may also consist of an elongated match similar to a fireplace match if it is selected to fit into the container.

The candles are selected to burn a certain length of time so that the row of candles all go out at approximately the same time. Additional candles may be supplied in the package in order to replace the burned-out candles so that the bags and sand may be re-used. The bags may be made of various materials and colors. For example, the bags may be translucent, opaque or water repellent and may be made fire retardant or of fireproof material. They may be provided with drain openings to allow water to escape if water falls on the sand.

In FIGS. 5 and 6 I have shown another form of the invention where the bag 21 serves as the container itself and all of the elements necessary for a single burning candle are packaged together in the bag and the bag is closed until the package is used by the user. The container in this form may be made of material which is similar to the bags disclosed herein above and shown in FIGS. 2, 3, and 4. The bag walls must offer sufficient rigidity to be self supporting in order to protect the burning candle. The bag should also preferably be made of material which has a certain degree of resistance to burning. This may be based upon an inherent fire resistance or to a treating or coating which renders the material fire retardant or fireproof. I have found paper bags to be very satisfactory containers, particularly if the paper is fire retardant. However, the walls may consist of one or more layers which may be either separate from each other or attached to each other. If multiple layers are used one or more layers may be flexible and one or more layers may be stiffer. One or more layers may be waterproof or water repellent. In this form each bag with its sand, candle or candles, match holder and measuring tape is closed at the open end to form a closed package. The open end may be folded over the side and secured to the side. Or the open end may be gathered together and tied. (This is not shown in the drawing). This single bag is particularly useful when only a few packages are needed. The sand is already pre-measured to fit the particular candle or candles in the package.

FIG. 6 illustrates another form of candle lighter 12. A wire is bent into a loop 13 at one end and the loop end is secured to the main body of the wire. A slider 14 surrounds the two parallel sides of the loop. When a match is inserted into the loop the slider may be moved toward the end of the loop to secure the match in the loop.

In FIGS. 7 and 8 I show a further form of package 31 where the single bag is made of stiff, rigid material and resembles a box with firm sides. It is also useful when only a few packages are required. This form of package is easily stacked and handled. The package contents are similar to the contents described in the form described in the immediately preceding lines. At least a portion of the walls should bend or fold in order to form a compact closed package. The folded over walls are secured to the other walls of the package.

Individual candles supported as disclosed herein above may be used alone for any desired suitable purpose. A candle may be used for illumination, or the candle supported in the open package may serve as a flare. If desired, any suitable chemical may be used in the wick or wax to provide a colored light. This is particularly suitable when used as a flare or as a Christmas candle.

When flexible bags 2 or 21 are used the bags may be folded down at the top as shown in FIGS. 3, 4 and 6 or may be left extending upwardly at the top depending upon the distance the upper edges of the bag extend above the candle.

I claim:

1. A Christmas candle package comprising: a container having a bottom, sides and a foldable top and containing:

a quantity of sand;

a means for measuring sand into an open bag;

one or more bags having walls of sufficient stiffness so that when a bag is opened and partially filled with sand the walls will remain erect, said bag having an opening in its wall to permit a hook to be inserted and hooked against the inside of the wall;

a tape measure having a hook at one end for engaging said bag wall through said opening to permit the user to measure off the distance between a bag, held in stationary position by the sand in the bag, and another bag;

one or more candles;

one or more matches; and a candle lighter for holding a match to light a candle when the candle is in upright position in the sand in said open bag, said lighter comprising a wire having a bent loop with parallel sides at one end and a slider surrounding the two parallel sides to compress the parellel sides and to permit the sides to engage a match inserted into the loop for lighting the candle in each successive bag to form a row of upright candles held in the sand and protected from the wind by the surrounding walls of the bags.

* * * * *